US010745256B2

(12) United States Patent
Hall et al.

(10) Patent No.: US 10,745,256 B2
(45) Date of Patent: Aug. 18, 2020

(54) DUAL-SCREW LINE GUIDE

(71) Applicant: Hall Labs, LLC, provo, UT (US)

(72) Inventors: David R. Hall, Provo, UT (US); Jerome Miles, Spanish Fork, UT (US); Daniel Madsen, Vineyard, UT (US); Dustin Clouse, Springville, UT (US)

(73) Assignee: Hall Labs LLC, Provo, UT (US)

( * ) Notice: Subject to any disclaimer, the term of this patent is extended or adjusted under 35 U.S.C. 154(b) by 147 days.

(21) Appl. No.: 16/034,345

(22) Filed: Jul. 12, 2018

(65) Prior Publication Data

US 2020/0017338 A1 Jan. 16, 2020

(51) Int. Cl.

*B66D 1/36* (2006.01)
*B65H 59/40* (2006.01)
*B65H 57/04* (2006.01)

(52) U.S. Cl.

CPC ..... *B66D 1/36* (2013.01); *B65H 57/04* (2013.01); *B65H 59/40* (2013.01)

(58) Field of Classification Search

CPC ..... B66D 1/36; B66D 2700/0191; B65H 2701/31; B65H 54/2812; B65H 57/04; B65H 59/40

See application file for complete search history.

(56) References Cited

U.S. PATENT DOCUMENTS 1,472,847 A * 11/1923 McGann ..... B65H 54/2812 242/482.9
1,551,251 A * 8/1925 Hopkins ..... B65H 54/2803 242/484.1
1,797,331 A * 3/1931 Dale ..... B66D 1/36 242/397.3
1,918,587 A * 7/1933 Bryant ..... B65H 54/2812 74/58
2,419,003 A * 4/1947 Bateman ..... B65H 54/2842 242/481.9
2,519,461 A * 8/1950 Hanson ..... B65H 54/2812 242/480.8
2,757,883 A * 8/1956 Franz ..... B66D 1/36 242/483.1
2,962,906 A * 12/1960 Cornish ..... B65H 54/2812 74/57
3,224,697 A * 12/1965 Struble, Jr. ..... B66D 1/36 242/388.7
3,266,741 A * 8/1966 Ferrier ..... B65H 54/48 242/481.8
3,347,490 A * 10/1967 Browning ..... H01Q 21/30 242/397.3
3,456,898 A * 7/1969 Anderson ..... B65H 54/2866 242/483.3
3,533,575 A * 10/1970 Laky ..... B66D 1/36 242/397.3

(Continued)

FOREIGN PATENT DOCUMENTS

GB 380910 A * 9/1932 ..... B66D 1/36
GB 670037 A * 4/1952 ..... B66D 1/36

*Primary Examiner* — Michael E Gallion

(57) ABSTRACT

A dual-screw line guide is disclosed. A first screw has a first helical groove. A second screw has a second helical groove. The first helical groove and the second helical groove align, thereby forming a groove space, as the first screw and the second screw rotate in opposing radial directions. The groove space is configured for a line to pass therethrough.

14 Claims, 5 Drawing Sheets

(56) References Cited

U.S. PATENT DOCUMENTS

| | | | | | |
|---|---|---|---|---|---|
| 3,587,994 | A * | 6/1971 | Freed, Jr. | B65H 54/2812 | 242/483.5 |
| 3,937,420 | A * | 2/1976 | Galis | B65H 54/28 | 242/483.1 |
| 4,005,834 | A * | 2/1977 | Landreau | B65H 54/2812 | 242/478.1 |
| 2019/0300344 | A1 * | 10/2019 | Cui | B66D 1/14 | |

* cited by examiner

DUAL-SCREW LINE GUIDE

TECHNICAL FIELD

The invention described herein relates generally to spooling.

BACKGROUND

Line guides, capable of keeping a line on track when winding or unwinding the line require the ability to handle forces in multiple directions. In many instances, the human hand is used to guide lines due to the expense and complexity of a line guide as well as due to the human capacity to handle changes in force and direction quickly. When using mechanical devices, such as a line guide for a winch pulling a load via a line, the line guide may experience forces in lateral directions. For example, a winch mounted facing one direction may be pulling on an object to the side of the face of the winch. The force may be partially compensated for by a fairlead, but when the forces become too high laterally, the line guide can be broken.

SUMMARY

In a first aspect, the disclosure provides an apparatus with a first screw and a second screw mounted adjacent and parallel to each other. The first screw has a first helical groove. The second screw has a second helical groove. The first helical groove and the second helical groove align, thereby forming a groove space, as the first screw and the second screw rotate in opposing radial directions. The groove space is configured for a line to pass therethrough.

In a second aspect, the first screw also has a first counter-helical groove that is counter-rotating to the first helical groove. The second screw has a second counter-helical groove that is counter-rotating to the second helical groove. The first counter-helical groove and the second counter-helical groove align as the first screw and the second screw rotate. The groove space consists of a first groove space and a second groove space. The first groove space is defined by the first helical groove and the second helical groove. The second groove space is defined by the first counter-helical groove and the second counter-helical groove. When the line is in the first groove space, rotation of the first screw and the second screw in opposing radial directions moves the line laterally to a first end of the first screw and the second screw. The line then switches from the first groove space to the second groove space and continued rotation causes the line to move laterally to the second end of the first screw and the second screw.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "spooling device" is meant to refer to a device that winds such as a spooler, winch, winder, and coilers.

As used herein, "line" is meant to refer to cable, wire, line, cord, twine, strand, or rope.

Line guides, capable of keeping a line on track when winding or unwinding the line, require the ability to handle forces in multiple directions. In many instances, the human hand is used to guide lines due to the human capacity to handle changes in force and direction quickly. When using mechanical devices, such as a line guide for a winch pulling a load via a line, the line guide may experience forces in lateral directions that are not compensated for by a fairlead, which can break the line guide. A line guide that can be used both with and without lateral loads is disclosed herein. In a preferred embodiment, the line guide consists of two bidirectional screws with grooves that align to leave a space between the screws. The line is passed through the space between the grooves. As the screws rotate, the line is moved laterally. Not only does this arrangement overcome the issue of lateral forces from the line, but has many benefits, some of which are presented herein.

Figure 1:
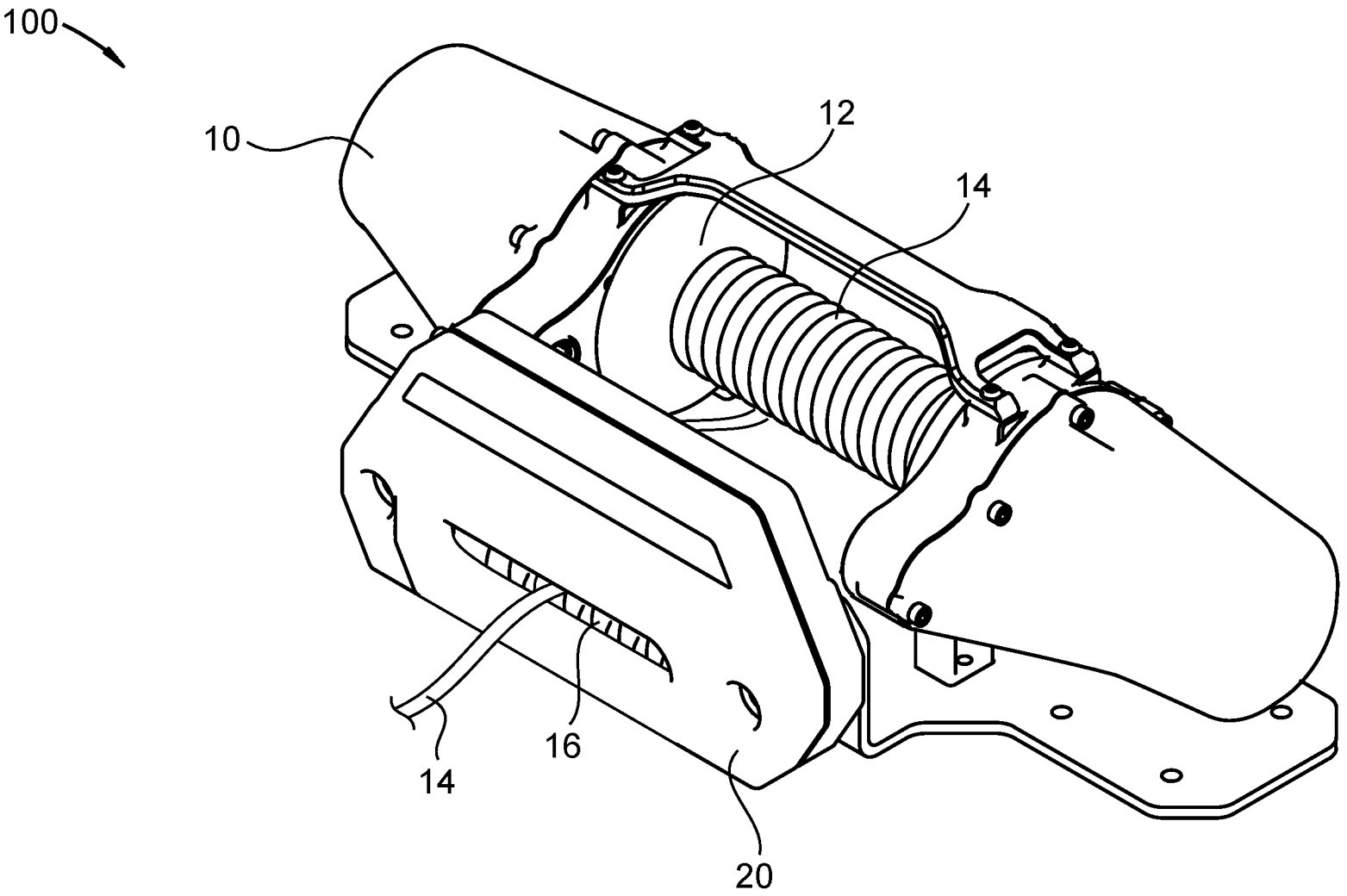
FIG. 1 is a front-right top isometric view of a winch with a dual screw.
Figure 2:
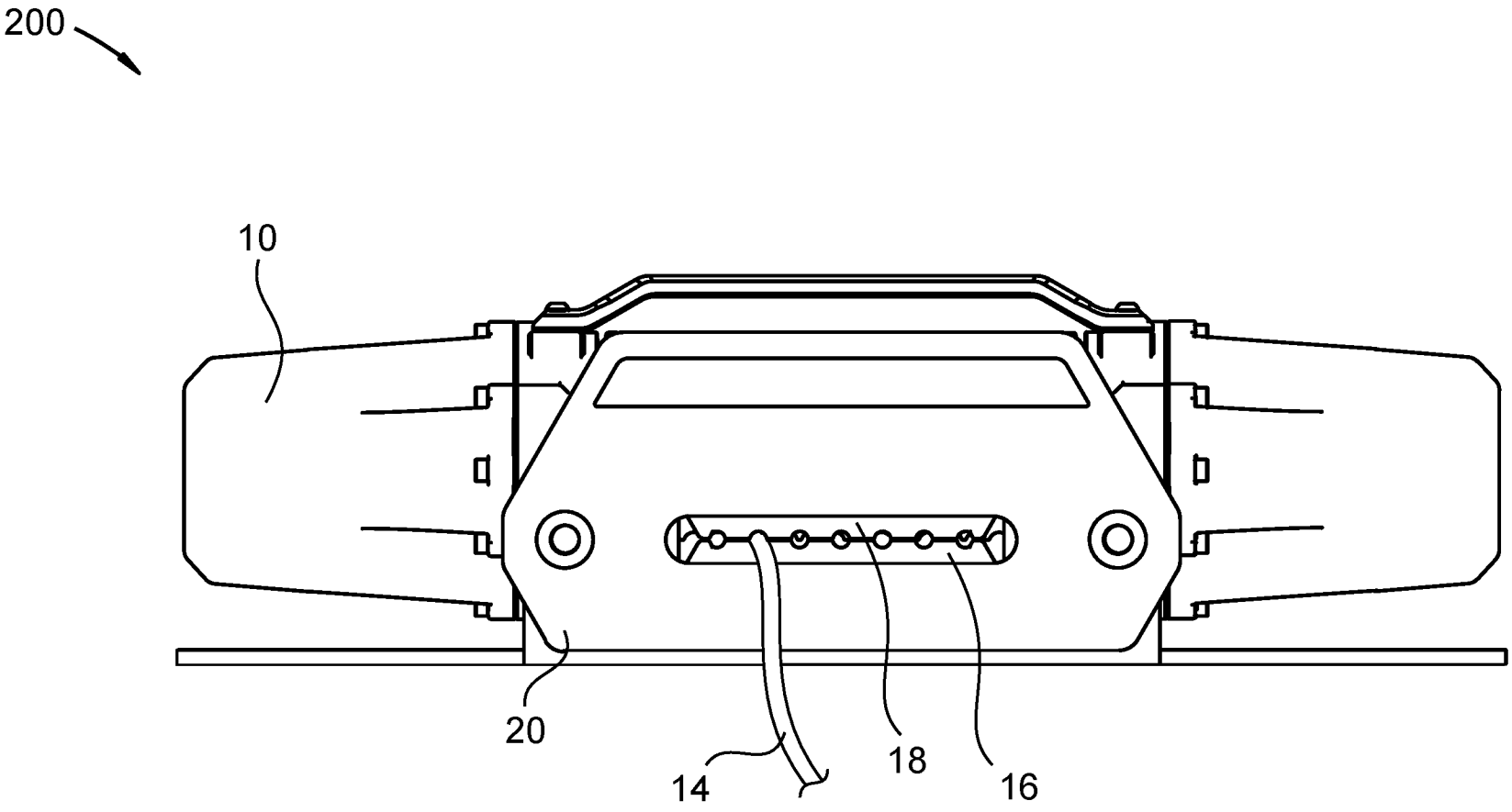
FIG. 2 is a front elevation view of the winch and dual screw of FIG. 1.
Figure 3:
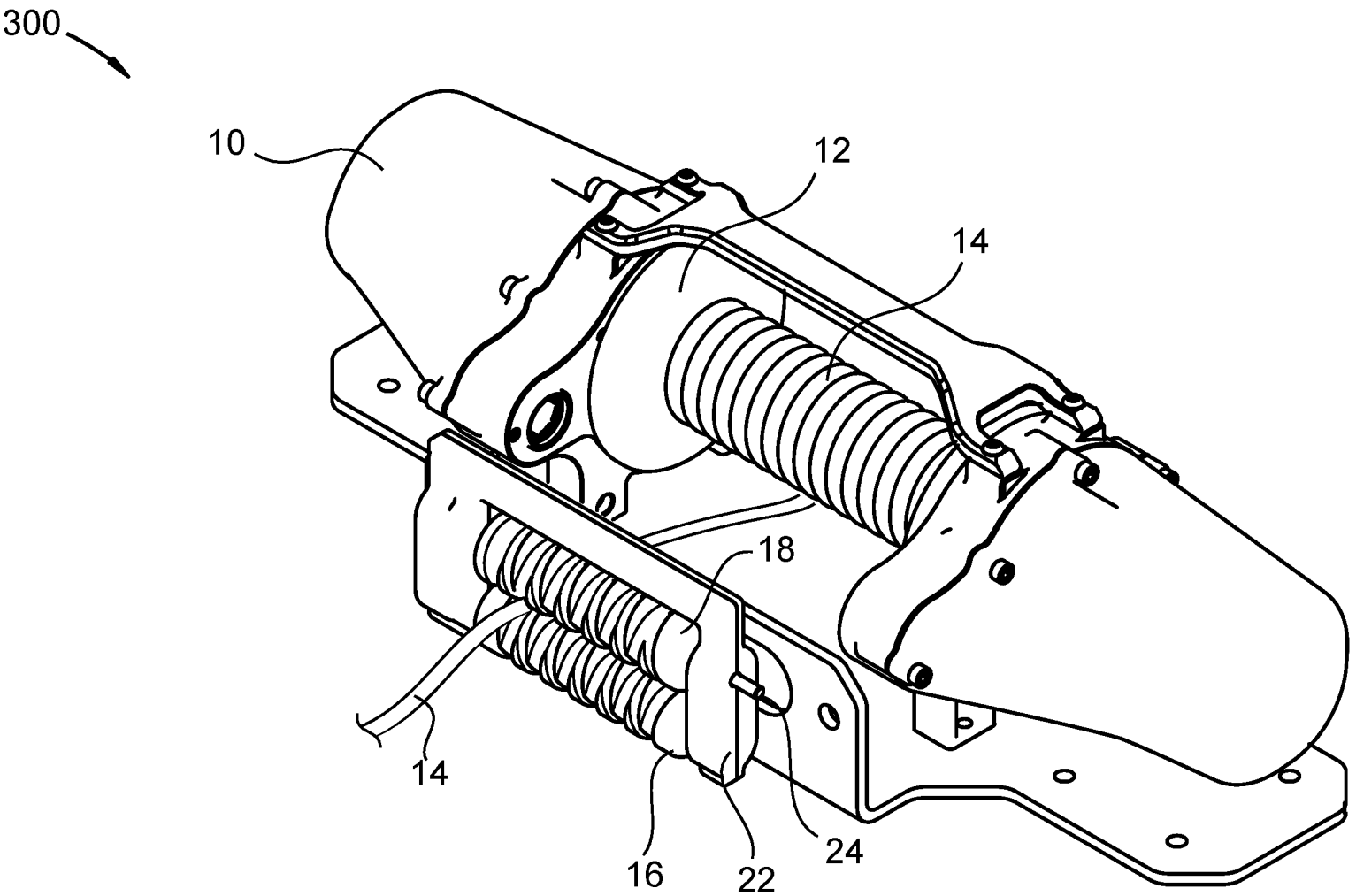
FIG. 3 is a front-right top isometric view of the winch and dual screw of FIG. 1 with an outer shell removed from the front of the dual screw.
Figure 4:
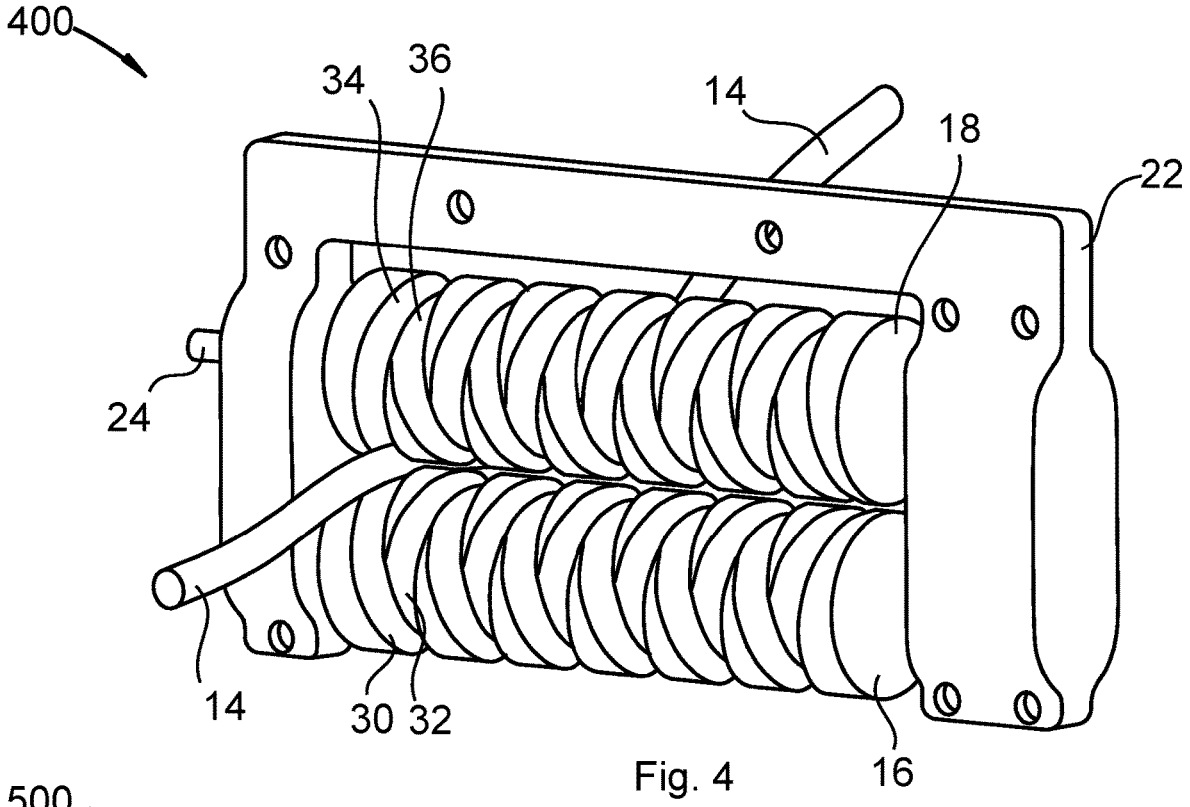
FIG. 4 is a rear-left top isometric view of the dual screw separated from the winch of FIG. 1.
Figure 5:
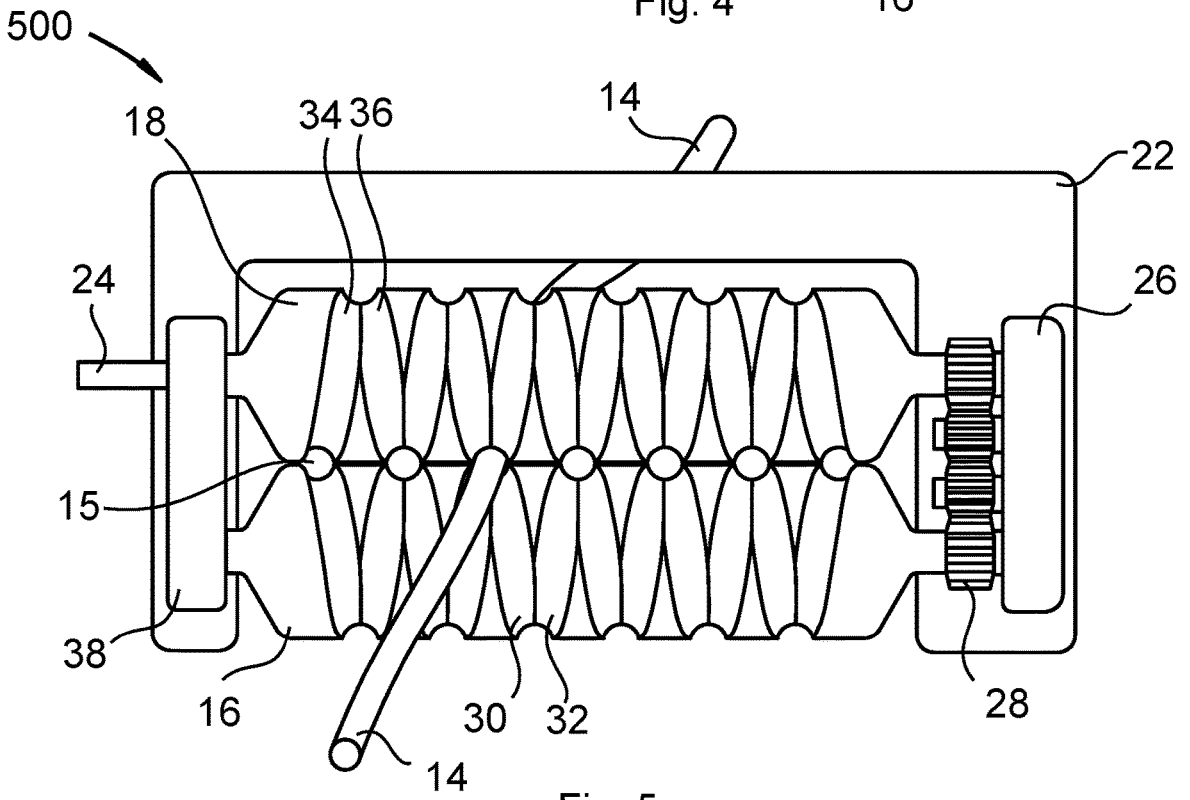
FIG. 5 is a rear elevation view of the dual screw of FIG. 4 with a portion of the casing around the gearing of the dual screw removed.
Figure 6:
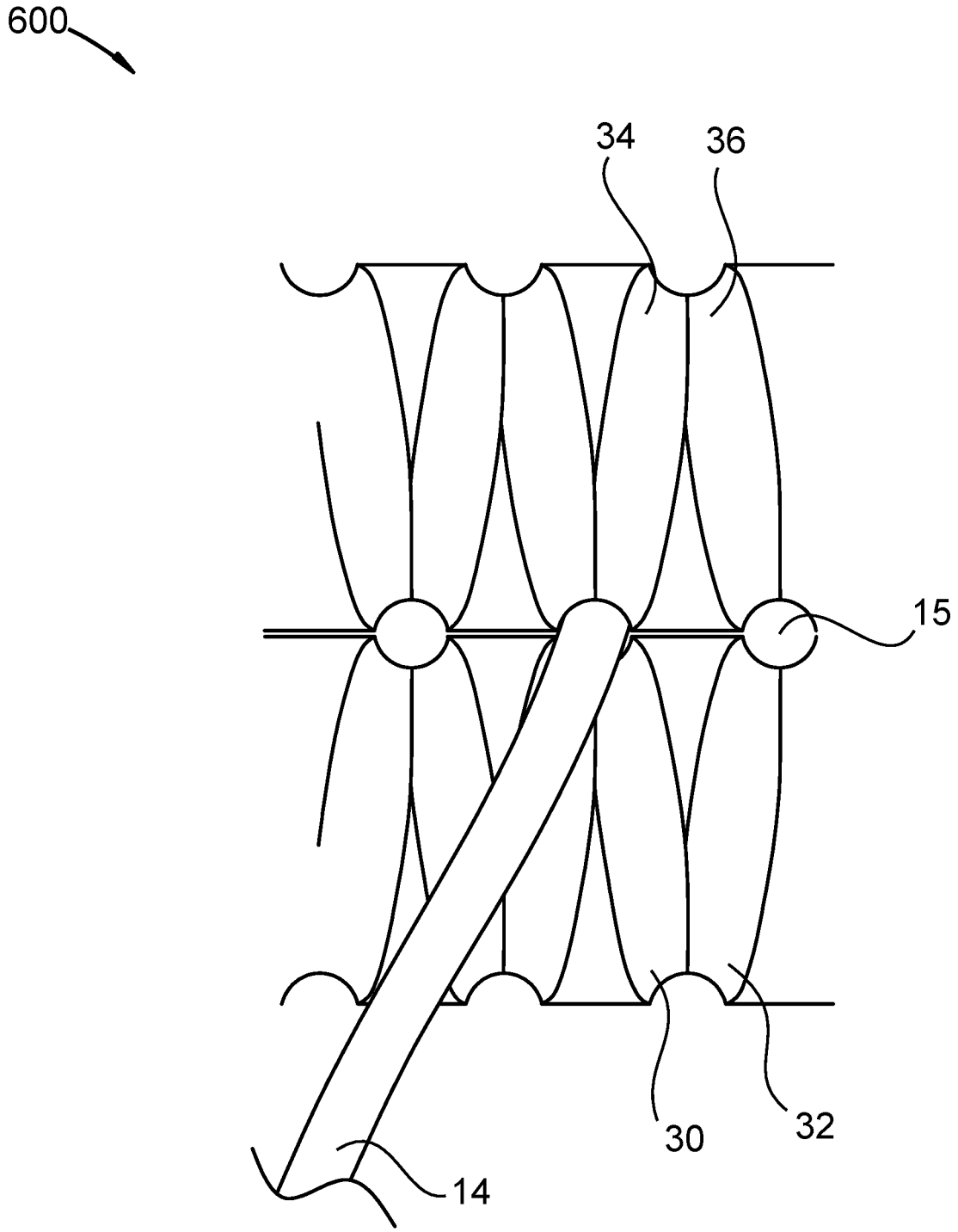
FIG. 6 is a front elevation close-up view of the dual screws of FIG. 4.

FIG. 1 is a front-right top isometric view 100 of a winch with a dual screw that may be used with the devices disclosed herein. FIG. 2 is a front elevation view 200 of the winch and dual screw of FIG. 1. FIG. 3 is a front-right top isometric view 300 of the winch and dual screw of FIG. 1 with an outer shell removed from the front of the dual screw. FIG. 4 is a rear-left top isometric view 400 of the dual screw separated from the winch of FIG. 1. FIG. 5 is a rear elevation view 500 of the dual screw of FIG. 4 with a back portion of the casing around the gearing of the dual screw removed. FIG. 6 is a front elevation close-up view 600 of the dual screws of FIG. 4. A winch 10 includes a spool 12 on which a line 14 is spooled and unspooled. A top screw 18 and a bottom screw 16 are mounted to a casing 22 which is mounted on the winch 10 inside of an outer shell 20. The top screw 18 and the bottom screw 16 are rotated counter to each other by turning shaft 24, thereby rotating the top screw 18 one direction while gearing 28 of gear assembly 26 causes the bottom screw 16 to rotate the opposite direction. The top screw 18 and the bottom screw 16 are thereby mounted adjacent and parallel to each other and rotate in opposing radial directions. The bottom screw 16 is a bidirectional helical screw with a first helical groove 30 and a first counter-helical groove 32. The top screw 18 is a bidirectional helical screw with a second helical groove 34 and a second counter-helical groove 36. The first helical groove 30 and the second helical groove 34 align as the top screw 18 and the bottom screw 16 rotate in opposing radial directions. The first counter-helical groove 32 and the second counter-helical groove 36 also align as the top screw 18 and the bottom screw 16 rotate in opposing radial directions. This alignment of grooves results in a groove space 15. In the present embodiment, the groove space 15 occurs in 7 locations. In other embodiments, the number of occurrences may be greater or fewer, depending on screw length and groove width. The line 14 passes through the groove space 15. As the screws 16 and 18 rotate counter to one another, the groove space 15 continually shifts, thus moving the line 14 laterally back and forth across the screw 16 and 18. As the line 14 reaches either end, the bidirectional nature of the screws 16 and 18 causes the line 14 to switch direction of travel. By controlling the speed of rotation of the spool 12 and the screws 16 and 18, the groove space 15 containing the line 14 is aligned with whatever point on the spool at which the line 14 is spooling or unspooling. The line 14 is withdrawn from the spool 12 by rotation of the top screw 18 in one direction (and the opposite direction by the bottom screw 16) and is spooled onto the spool 12 by rotation of the top screw 18 in the opposite direction (and the first direction by the bottom screw 16).

In some embodiments, the line 14 has a diameter at least as large as the groove space 15. In some embodiments, a member 38 contains a tensioner that applies a squeezing force that pushes the first screw and the second screw together such that the line 14 is squeezed between the top screw 18 and the bottom screw 16. By squeezing the line 14 during unspooling of the spool 12, the line 14 is kept taut while being drawn out of the winch 10. By removing the tension during spooling of the spool 12, the line is guided by the groove space 15 but is not restricted in returning to the winch 10 by extra pressure on line 14.

In some embodiments, one or more sensors are used to detect lateral forces applied by the line to the first screw, the second screw, or both. For example, these sensors may be optical sensors mounted in member 38, in gear assembly 26, or in both. As the sensors detect the force is over a force threshold, the squeezing force from the tensioner is increased. This prevents the line 14 from being pulled out of the groove space 15. In some embodiments, as the force passes the force threshold, the rotational speeds of the spool 12 and screws 16 and 18 is altered to compensate for the increased squeezing force.

In some embodiments, one or more sensors are used to detect the location of the line 14 between screws 16 and 18 and compare it to the point on the spool where the line 14 is winding or unwinding. For example, these sensors may be mounted on the interior of the outer shell 20 and may include laser distance finders or other proximity sensors. When the sensors determine that the location of the line 14 is misaligned with the point on the spool, the tensioner may be released and the screws 16 and 18 may be rotated to bring the line 14 into alignment with the point on the spool. In some embodiments, rotation of the spool 12 is paused. In other embodiments, rotation of the spool 12 is slowed.

In some embodiments, a single motor with gearing is used for the winch and both screws. In other embodiments, a first motor is used for the winch and a second motor with gearing is used for the screws. In another embodiment, the winch and both screws all have independent motors.

In some embodiments, the screws are single directional with only a single groove each, moving the line a single direction.

In some embodiments, the line is a cable, a wire, a line, a cord, twine, a strand, or a rope. Preferably, the line is a cable made of braided metal strands.

In some embodiments, the first screw and the second screw may have rounded crests.

In some embodiments, portions of the screws have ribbed textures to increase grasping ability by the screws.

In some embodiments, the screws are made of steel, stainless steel, foam, rubber, plastic, or a combination thereof. In some embodiments the screws are heat treated, surface hardened, or a combination thereof. In one example, the screws are 1.5" in diameter for a 12,000 lbf rated winch with grooves of ⅜" diameter for a ⅜" diameter line.

In some embodiments, the screws have coatings including titanium nitride, titanium carbo-nitride, titanium aluminum nitride, aluminum titanium nitride, chrome nitride, zirconium nitride, chrome, or a combination thereof.

The invention has been described with reference to various specific and preferred embodiments and techniques. Nevertheless, it is understood that many variations and modifications may be made while remaining within the spirit and scope of the invention.

What is claimed is:

1. An apparatus comprising:

a first screw comprising a first helical groove and a second screw comprising a second helical groove, the first screw and the second screw mounted adjacent and parallel to each other;

wherein the first helical groove and the second helical groove align, thereby forming a groove space, as the first screw and the second screw rotate in opposing radial directions; and wherein the groove space is configured for a line to pass therethrough; and wherein the first screw further comprises a first counter-helical groove that is counter-rotating to the first helical groove, wherein the second screw further comprises a second counter-helical groove that is counter-rotating to the second helical groove, and the first counter-helical groove and the second counter-helical groove align as the first screw and the second screw rotate.

2. The apparatus of claim 1, wherein when the line is in the groove space, rotation of the first screw and the second screw in opposing radial directions moves the line laterally to a first end of the first screw and the second screw, whereupon the line switches directions and continued rotation causes the line to move laterally to the second end of the first screw and the second screw.

3. The apparatus of claim 1, further comprising a winch with a spool, the line spooling onto or unspooling from the spool at a point.

4. The apparatus of claim 3, wherein the groove space aligns with the point on the spool.

5. The apparatus of claim 4, wherein the line comprises a line diameter at least as large as the groove space.

6. The apparatus of claim 5, further comprising a tensioner, wherein the tensioner applies a squeezing force that pushes the first screw and the second screw together such that the line is squeezed between the first screw and the second screw.

7. The apparatus of claim 6, further comprising a motor and gearing for the winch, the first screw, and the second screw.

8. The apparatus of claim 6, further comprising a first motor for the winch, a second motor for the first screw, and a third motor for the second screw.

9. The apparatus of claim 6, wherein rotating the first screw in a first rotational direction while rotating the second screw in the opposite rotational direction passes the line through the groove space towards the spool, and wherein rotating the first screw in the opposite rotational direction while rotating the second screw in the first rotational direction passes the line through the groove space away from the spool.

10. The apparatus of claim 6, further comprising one or more sensors that detect lateral forces applied by the line to the first screw, the second screw, or the first screw and the second screw.

11. The apparatus of claim 10, wherein the squeezing force is increased as the one or more sensors detect the lateral forces are over a force threshold.

12. The apparatus of claim 1, wherein the line comprises a cable, a wire, a line, a cord, twine, a strand, or a rope.

13. The apparatus of claim 1, wherein a portion of the first screw and a portion of the second screw comprise ribbed textures.

14. The apparatus of claim 1, wherein the first screw and the second screw comprise coatings selected from the group consisting of titanium nitride, titanium carbo-nitride, titanium aluminum nitride, aluminum titanium nitride, chrome nitride, zirconium nitride, chrome, and combinations thereof.

* * * * *